US009281614B1

(12) United States Patent
Bonucci et al.

(10) Patent No.: US 9,281,614 B1
(45) Date of Patent: Mar. 8, 2016

(54) CONNECTOR ASSEMBLY HAVING LOCKING MEMBERS

(71) Applicant: TYCO ELECTRONICS BRASIL LTDA., Sao Paulo (BR)

(72) Inventors: Gustavo Bonucci, Braganca Paulista (BR); Peterson Pulgrossi, Campinas-SP (BR)

(73) Assignee: TYCO ELECTRONICS BRASIL LTDA, Sao Paulo (BR)

( * ) Notice: Subject to any disclaimer, the term of this patent is extended or adjusted under 35 U.S.C. 154(b) by 38 days.

(21) Appl. No.: 14/507,382

(22) Filed: Oct. 6, 2014

(51) Int. Cl.
*H01R 13/62* (2006.01)
*H01R 13/627* (2006.01)

(52) U.S. Cl.
CPC ..... *H01R 13/6272* (2013.01)

(58) Field of Classification Search
CPC ..... H01R 13/6272
USPC ..... 439/310, 157–160, 372, 352
See application file for complete search history.

(56) References Cited

U.S. PATENT DOCUMENTS 4,410,222 A * 10/1983 Enomoto ..... H01R 12/79 439/157
6,558,176 B1 5/2003 Martin et al.
7,175,451 B2 2/2007 Shuey
7,384,285 B2 6/2008 Patterson et al.
8,292,652 B2 10/2012 Rohde et al.

* cited by examiner

*Primary Examiner* — Javaid Nasri

(57) ABSTRACT

A connector assembly including a housing and a cover. The cover including a locking member receiving portion and a lever retaining portion. A lever rotatable between an unlatched position and a latched position is provided. The lever is positioned in the lever retaining portion when the lever is in the latched position. A locking member is movably retained in the locking member receiving portion. The locking member is moveable between an unlocked position and a locked position. A portion of the locking member is positioned in the lever retaining portion when the locking member is in the locked position. The locking member engages the lever when the locking member is in the locked position to properly secure the lever in the latched position and to ensure continuous latching of the connector assembly.

20 Claims, 8 Drawing Sheets

CONNECTOR ASSEMBLY HAVING LOCKING MEMBERS

FIELD OF THE INVENTION

The present invention relates generally to electrical connectors, and more particularly to a locking member for a lever actuated connector.

BACKGROUND OF THE INVENTION

In certain applications, electrical connectors must be securely mated to one another to prevent disconnection of the electrical signals routed through the connector conductors. For example, in automotive applications wherein electrical signals are routed to safety equipment such as air bag deployment systems or other systems relating to the operational or safety features of the vehicle, disconnection of the electrical signals as a result of accident, operating conditions such as vibration, etc. may result in undesirable consequences. Thus, some electrical connectors are coupled to connector assemblies that mechanically lock the electrical connectors in mating engagement with one another.

Some conventional connector assemblies include a housing that houses an electrical connector, a wire guide attached to the housing and enclosing the electrical connector, and a lever that couples the housing to a header housing of a mating electrical connector. U.S. Pat. Nos. 6,558,176 and 7,384,285 are such examples. When in a locked position, the lever prevents disconnection of the housing from the header, which prevents disconnection of the mated electrical connectors. Some levers are further configured to latch into engagement with a wire guide when the lever is in the locked position thereby ensuring that the lever is not unintentionally moved out of the locked position. As these latches may be used over multiple cycles, it is desirable that the latch not be overstressed as the latch is in use or as the latch is moved between the latched and the unlatched position.

A need remains for a simple and effective latching/locking member and latching/locking system which can be reliably used over many cycles, which ensures that the lever actuated connector is initially properly secured to a mating connector, which ensures that the lever actuated connector remains continuously secured to the mating connector, and/or which ensures that the lever actuated connector is not unintentionally moved out of the locked position.

SUMMARY OF THE INVENTION

An embodiment is directed to a connector assembly including a housing and a cover. The cover includes a locking member receiving portion and a lever retaining portion. A lever rotatable between an unlatched position and a latched position is provided. The lever is positioned in the lever retaining portion when the lever is in the latched position. A locking member is movably retained in the locking member receiving portion. The locking member is moveable between an unlocked position and a locked position. A portion of the locking member is positioned in the lever retaining portion when the locking member is in the locked position. The locking member engages the lever when the locking member is in the locked position to properly secure the lever in the latched position and to ensure continuous latching of the connector assembly.

An embodiment is directed to a connector assembly including a cover with a locking member receiving portion and a latch retaining portion. A latch, positioned in the latch retaining portion when the latch is in the latched position, is movable between an unlatched position and a latched position. A locking member is movably retained in the locking member receiving portion and is moveable between an unlocked position and a locked position. A portion of the locking member is positioned in the latch retaining portion when the locking member is in the locked position. The locking member engages the latch when the locking member is in the locked position to properly secure the latch in the latched position and to ensure continuous latching of the connector assembly.

An embodiment is directed to a connector assembly including a cover with a locking member receiving portion and a latch retaining portion. A latch, positioned in the latch retaining portion when the latch is in the latched position, is movable between an unlatched position and a latched position. A locking member is movably retained in the locking member receiving portion and is moveable between an unlocked position and a locked position. The locking member includes a retention member and a latch engagement portion. The retention member engages the latch when the locking member is in the locked position. The lever engagement portion is positioned proximate to the retention member and cooperates with the latch as the latch is moved from the unlatched position to the latched position. The retention member engages the latch when the locking member is in the locked position to properly secure the latch in the latched position and to ensure continuous latching of the connector assembly.

Other features and advantages of the present invention will be apparent from the following more detailed description of the preferred embodiment, taken in conjunction with the accompanying drawings which illustrate, by way of example, the principles of the invention.

Figure 1:
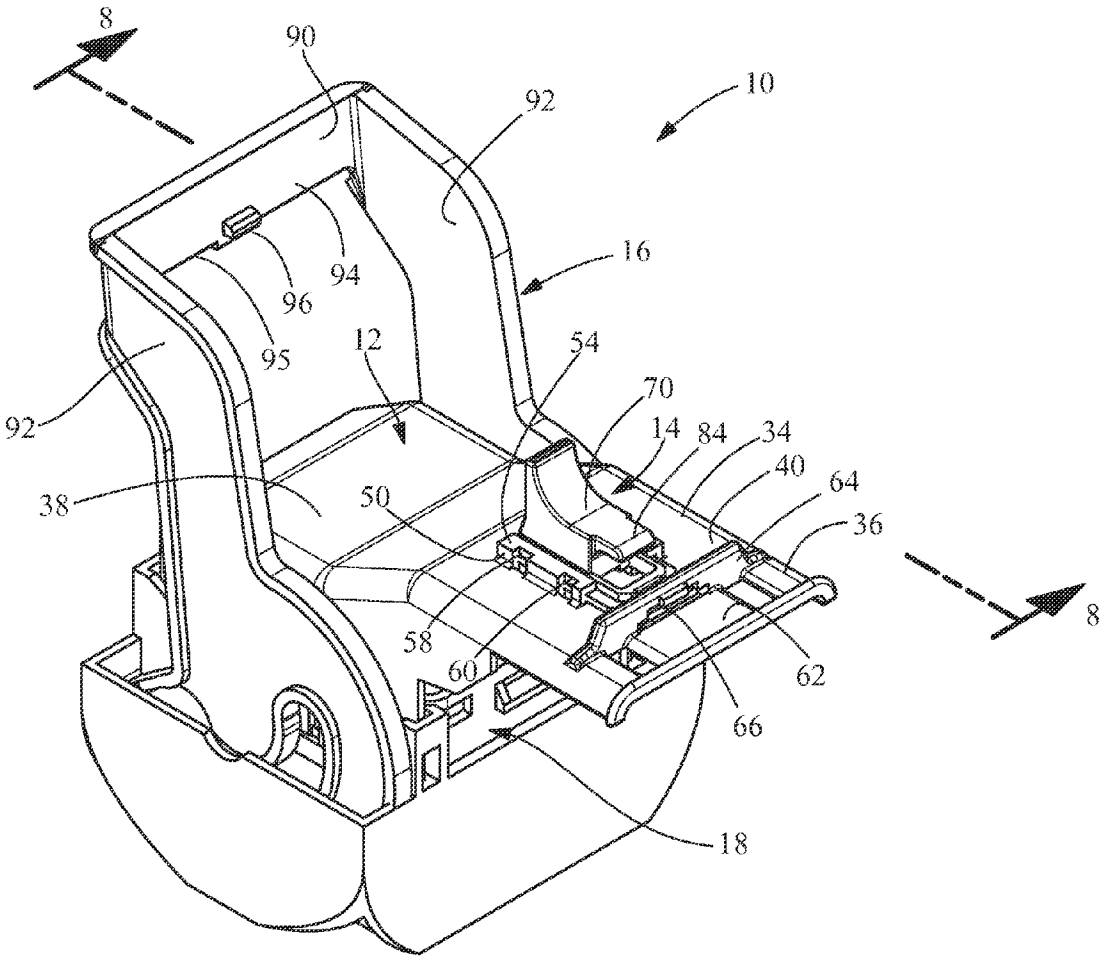
FIG. 1 is a perspective view of an illustrative embodiment of a lever mated connector assembly according to the present invention depicting the lever in an unlocked position.

Corresponding reference characters indicate corresponding parts throughout the several views. Although the drawings represent illustrative embodiments of the present invention, the drawings are not necessarily to scale and certain features may be exaggerated in order to better illustrate and explain the present invention.

DETAILED DESCRIPTION OF THE INVENTION

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

Referring first to FIG. 1, an illustrative embodiment of the invention will be described. As shown first in FIG. 1, a latch/lever mated connector assembly 10 includes a cover or wire guide 12, a locking member 14, a latch or rotatable lever 16 and a housing 18. The lever 16 is rotatable between the position of FIG. 1, to the position of FIG. 3 where it is locked in place by locking member 14, as will be more fully described. While illustrative lever 16 and housing 18 are shown, the lever 16 and housing 18 may be any of various levers and housings known in the art. The housing 18 is dimensioned to mate with a pin header or other mating connector as is known in the art.

Figure 4:
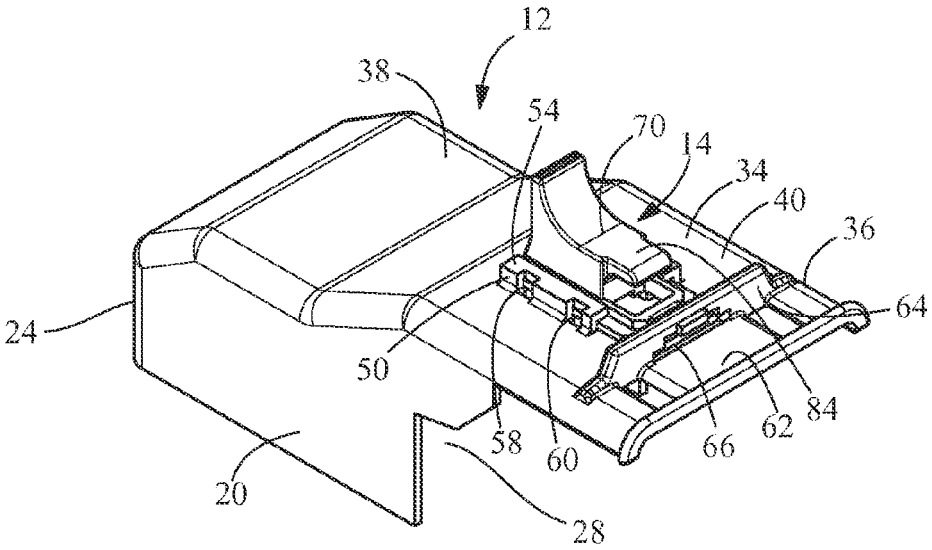
FIG. 4 is a perspective view of a cover of the lever mated connector, showing the locking member attached to the cover in an unlocked position.
Figure 5:
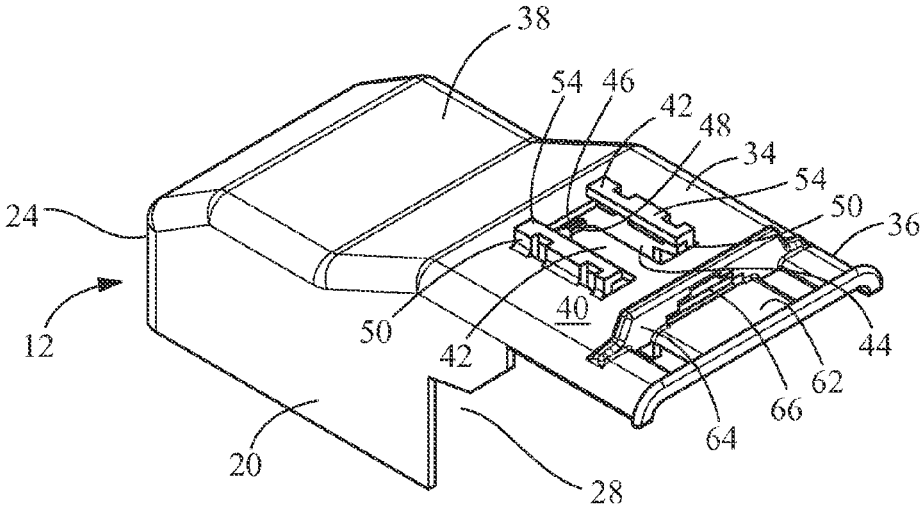
FIG. 5 is a perspective view similar to that of FIG. 4 with the locking member removed.
Figure 6:
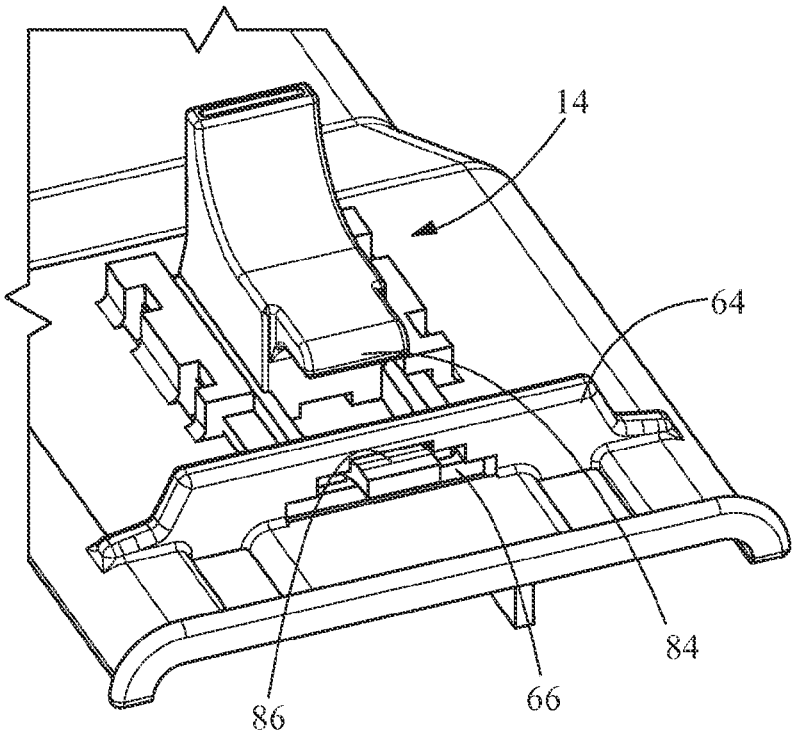
FIG. 6 is an end view of the cover with the locking member positioned in a receiving portion of the cover.
Figure 7:
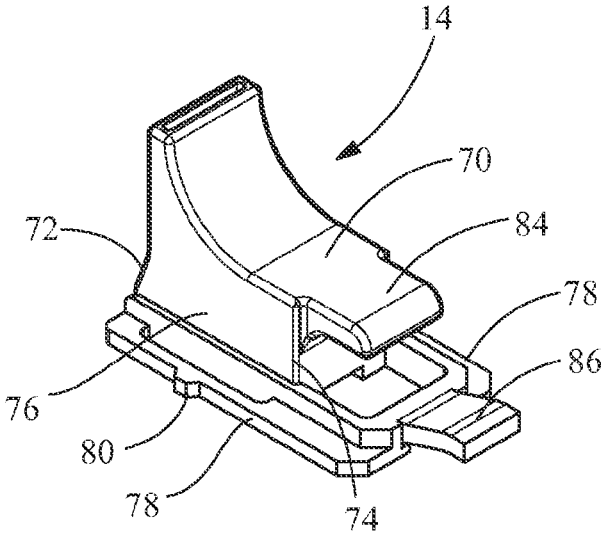
FIG. 7 is a perspective view of the locking member.

As best shown in FIGS. 4 and 5, the cover 12 includes sidewalls 20 and end wall 24, defining an interior space 28. The cover 12 includes tabs (not shown) which retain the wire guide 12 to the housing 18. Alternatively, the cover 12 may be secured to the housing 18 using other known methods. As shown in FIG. 5, the wire guide 12 includes a locking member receiving portion 34, a latch/lever retaining portion 36 and a shroud 38. The cover 12 is made from plastic or other non-conductive material having the appropriate strength characteristics.

As best shown in FIG. 5, the locking member receiving portion 34, which movably retains the locking member 14 therein, includes a top flat wall 40 with retaining wedges or latches 42, defined by cutouts 44 molded in the cover 12. The retaining latch 42 includes a camming surface 46 together with a retaining surface 48. Dovetail flanges 50 are provided on either side of the latch 42. The flanges 50 extend essentially parallel to each other and essentially parallel to the sidewalls 20. The flanges 50 include inwardly extending ridges 54. The flanges 50 have openings 58, 60 which cooperate with the locking member 14 to help to retain the locking member 14 in a first and second position.

The latch/lever retaining portion 36 intersects with the locking member receiving portion 34. The latch/lever retaining portion 36 includes a flat surface 62 and a projection or wall 64 which extends upward (as viewed in FIG. 5) from the flat surface 62. The wall 64 has an opening 66 which extends therethrough.

As best shown in FIGS. 7-10, the locking member 14 has a top wall 70, a back wall 72, a front wall 74 and sidewalls 76. Flanges 78 extend outwardly from the sidewalls 76. Projections 80 extend from the flanges 78. A supporting rib or ribs 82 extend between the sidewalls 76 and the top wall 70. The locking member 14 is made from plastic or other material having the appropriate strength characteristics.

In the illustrative embodiment shown, the top wall 70 has a curved configuration providing an ergonomic design which allows the user to engage the top wall 70 with a finger or other device and move the locking member 14 between a first or unlocked position and a second or locked position. A latch/lever retention member 84, which in the embodiment shown is integral with the top wall 70, extends from the front wall 74 in a direction away from the back wall 72.

A latch/lever engagement portion 86 extends between the sidewalls 76. The latch/lever engagement portion 86 has a curved configuration to cooperate with the latch/lever 16, as will be more fully described. The latch/lever engagement portion 86 is positioned proximate to, but removed from the retention member 84. The latch/lever engagement portion 86 cooperates with the latch/lever 16 as the latch/lever 16 is moved from the unlatched position to the latched position, as will be more fully described.

Figure 8:
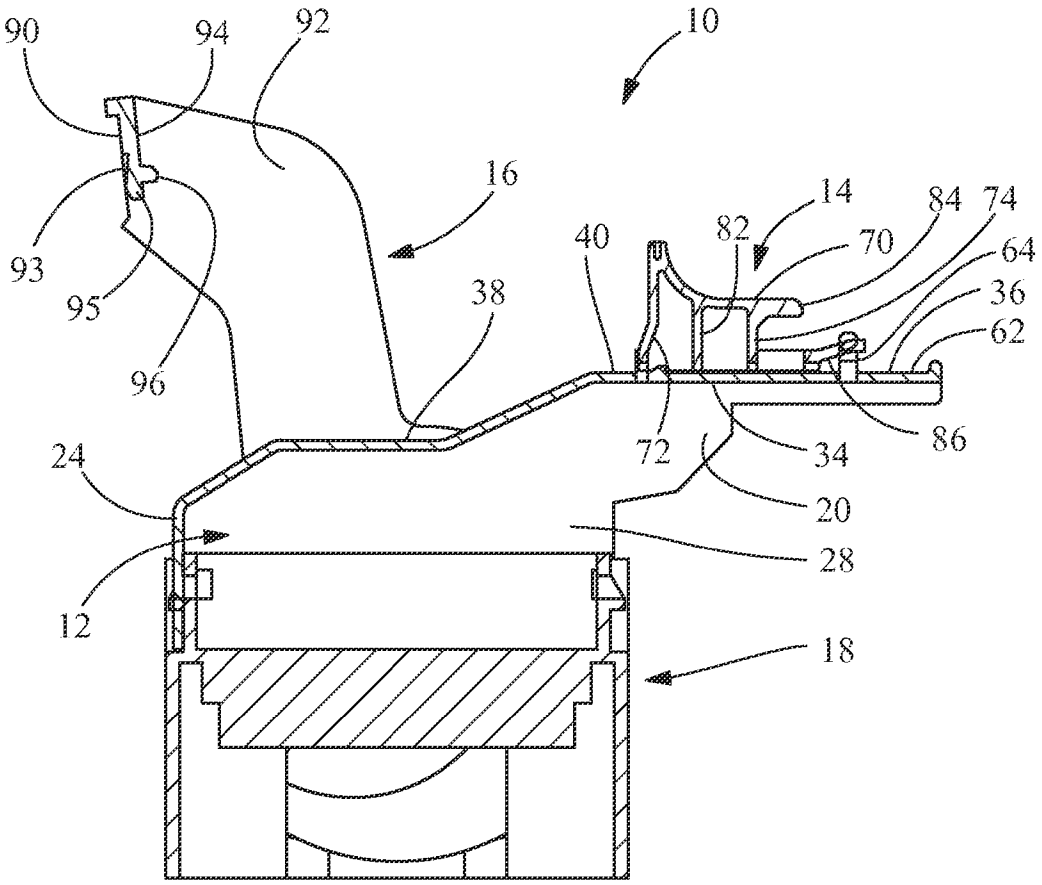
FIG. 8 is an enlarged cross sectional view through lines 8-8 of FIG. 1.
Figure 9:
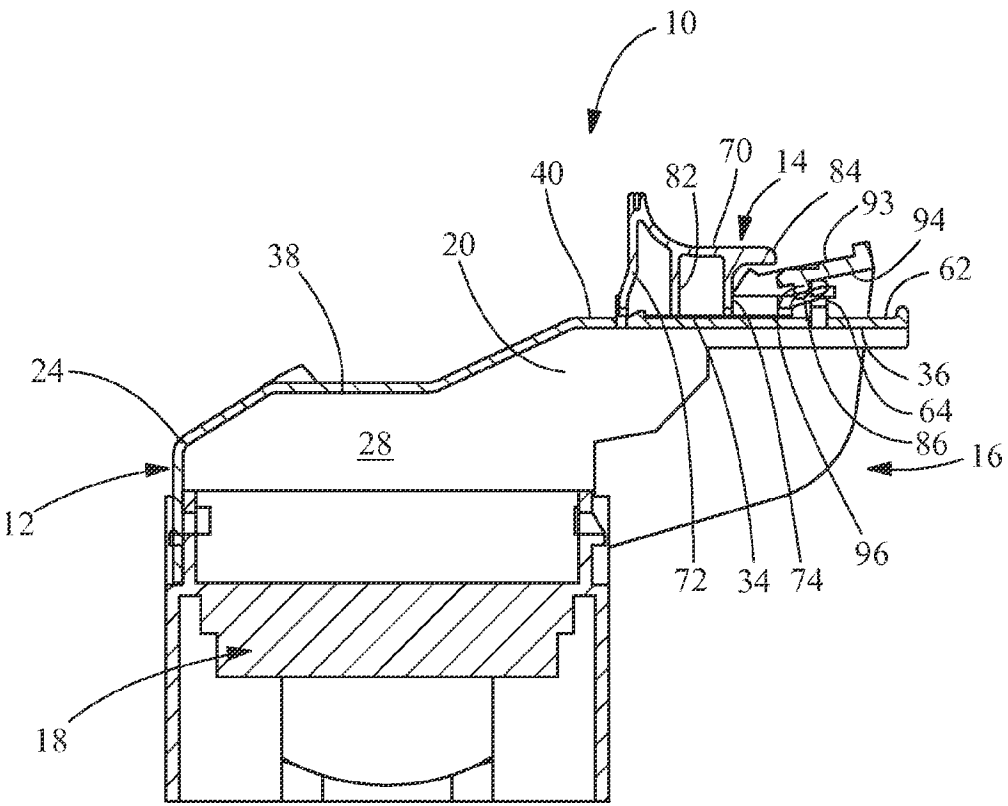
FIG. 9 is an enlarged cross sectional view through lines 9-9 of FIG. 2.
Figure 10:
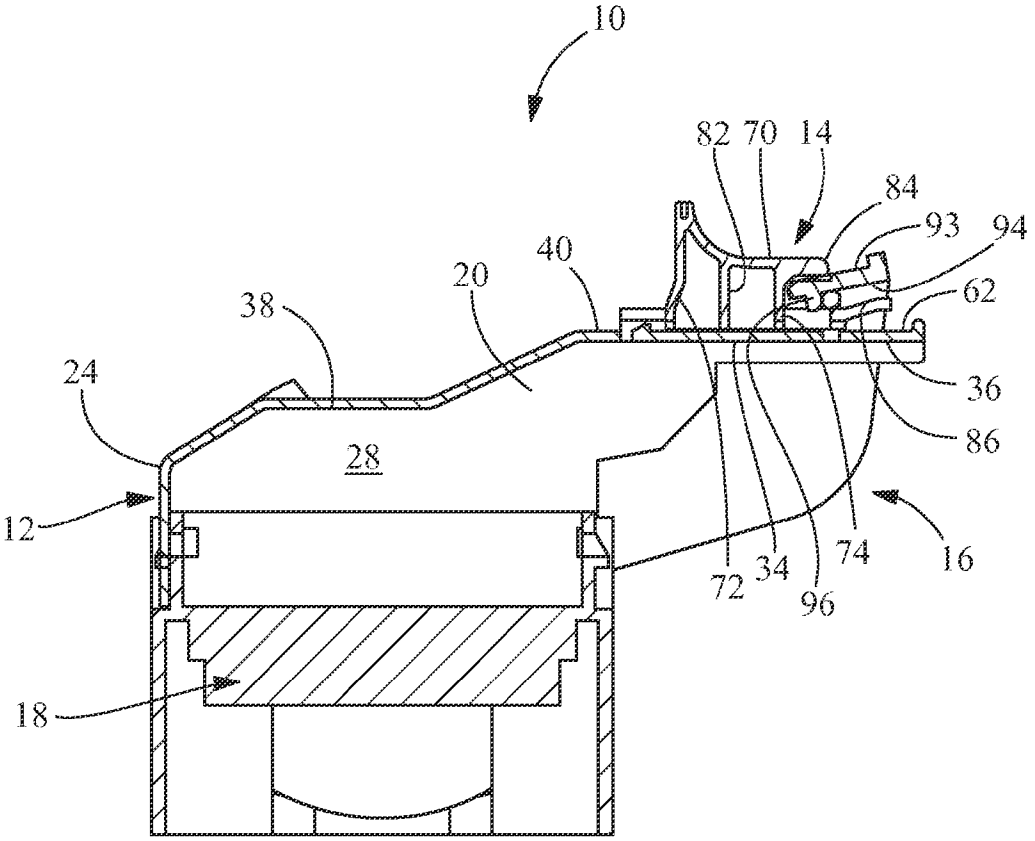
FIG. 10 is an enlarged cross sectional view through lines 10-10 of FIG. 3.

As best shown in FIGS. 1 and 8, the lever 16 includes a handle 90 having support arms 92. The handle 90 has an upper surface 93, a lower surface 94 and a forward edge 95. A wall or projection 96 extends from the lower surface 94 in a direction away from the upper surface 93. The projection 96 is positioned proximate the forward edge 95. While a lever 16 is shown, a latch or other mechanism can be used to secure the assembly 10 to a mating connector.

When the assembly 10 is in an unlatched position, as best shown in FIGS. 1 and 8, the locking member 14 is retained in a first or unlocked position. In this first position, the locking member 14 is positioned in the locking member receiving portion 34 and only the latch/lever engagement portion 86 extends to the latch/lever retaining portion 36. The remainder of the locking member 14 is retained in the locking member receiving portion 34 and does not extend to the latch/lever retaining portion 36. In this position, the flanges 78 of the locking members 14 cooperate with the dovetail flanges 50 and the ridges 54 of the locking member receiving portion 34 to maintain the locking member 14 on the flat wall 40 of the locking member receiving portion 34. This prevents movement of the locking member 14 in a direction which is perpendicular to the longitudinal axis of the dovetail flanges 50.

In this position, the supporting rib 82 of the locking member 14 engages the latch 42 of the locking member receiving portion 34 to prevent movement of the locking member 14 in a direction away from the latch/lever retaining portion 36. In addition, the projections 80 of the flanges 78 of the locking member 14 are positioned in the openings 58 of the locking member receiving portion 34 to prevent the unwanted movement of the locking member 14 toward the latch/lever retaining portion 36.

Additionally, in some embodiments, the unwanted movement of the locking member 14 is also prevented by the cooperation of the latch/lever engagement portion 86 of the locking member 14 with the wall 64 of the latch/lever retaining portion 36 of the cover 12. When the connector is in the position of FIG. 1, the movement of the locking member 14 is prevented, as a forward surface of the latch/lever engagement portion 86 abuts against the wall 64.

Figure 2:
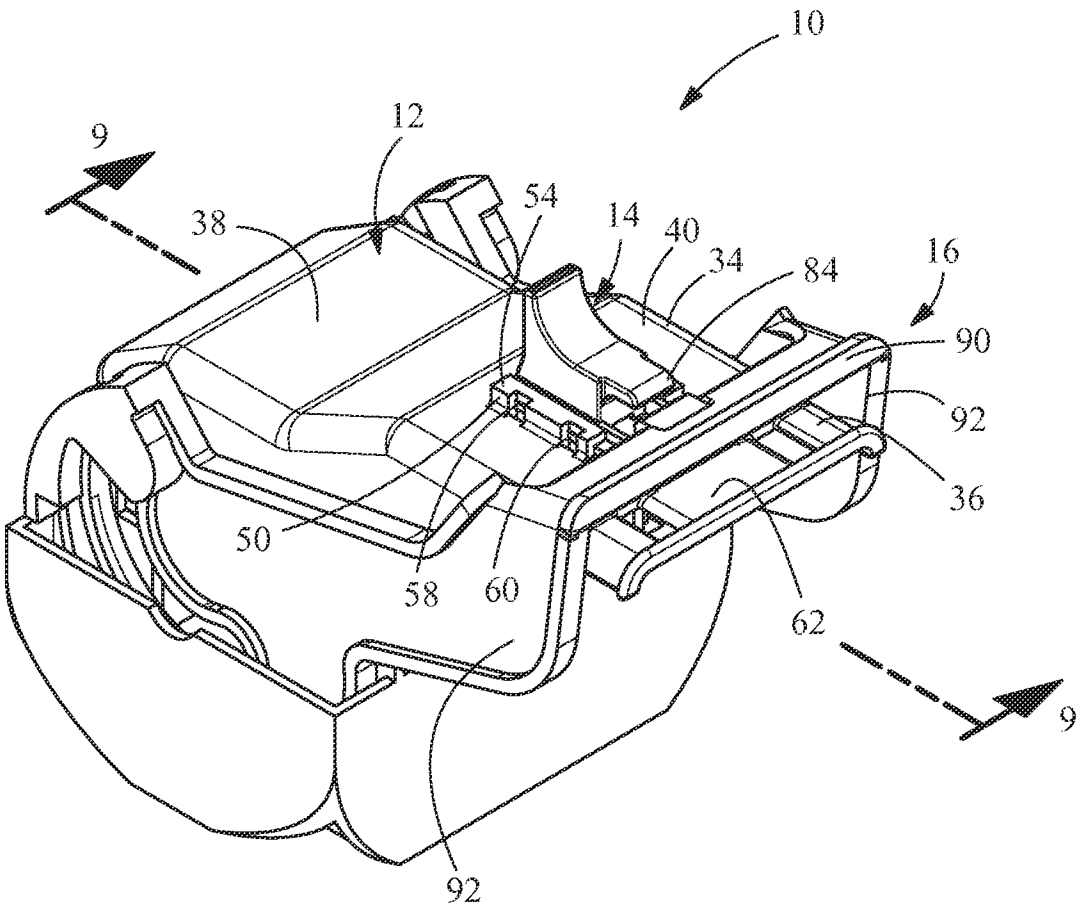
FIG. 2 is a view similar to that of FIG. 1 showing the lever in a fully engaged position, with a locking member in a first or unlocked position.

With the locking member 14 movably retained in the first position, the latch/lever 16 is rotated from the unlatched position toward the latched position, as shown in FIG. 2. As this occurs, the projection 96 of the latch/lever 16 engages the latch/lever engagement portion 86 of the locking member 14, preventing the continued rotation of the latch/lever 16 toward the latch/lever retaining portion 36 is prohibited.

However, in embodiments in which the forward surface of the latch/lever engagement portion 86 abuts against the wall 64 when the locking member 14 is in the first position, the movement of the latch/lever 16 is continued to cause the latch/lever engagement portion 86 to resiliently deflect toward the flat surface 62 of the latch/lever retention portion 36, thereby allowing the latch/lever engagement portion 86 to align with the opening 66 of the wall 64. This allows the locking member 14 to be moved through the opening 66 from the first position to the second position, as will be more fully described.

Figure 3:
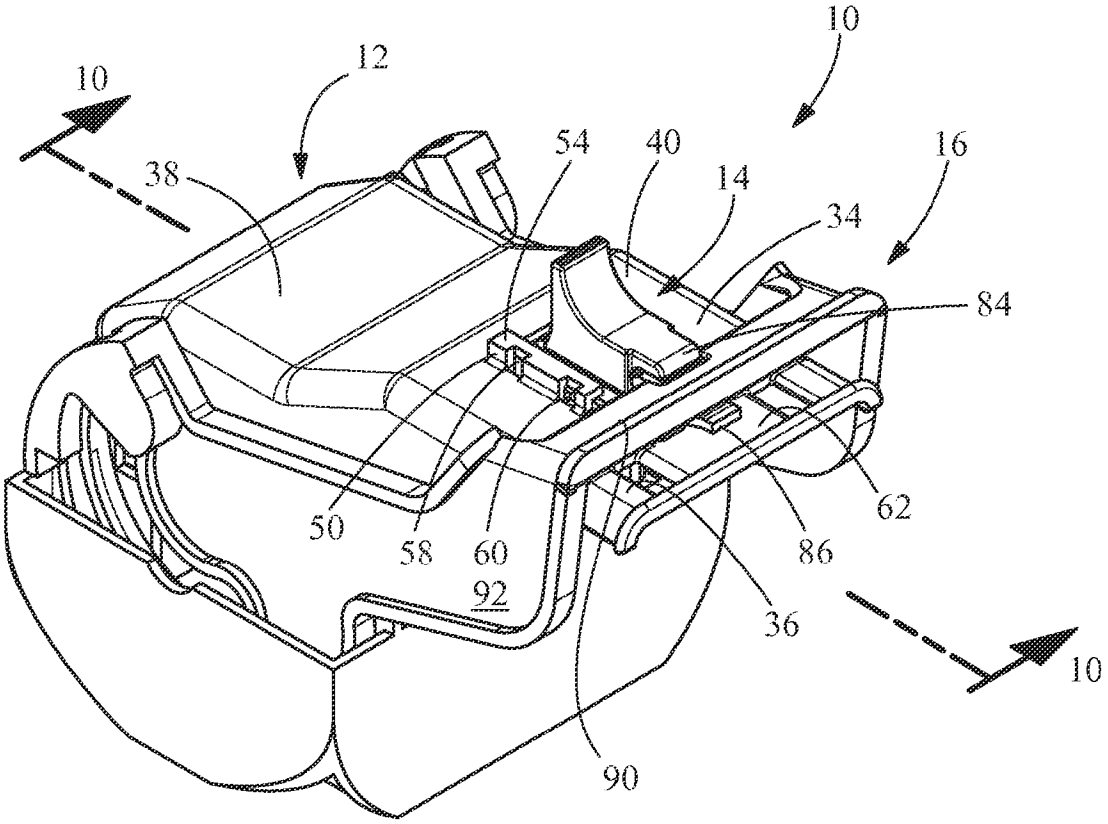
FIG. 3 is a view similar to that of FIG. 1 showing the lever in the fully engaged position, with the locking member in a second or locked position.

With the projection 96 of the latch/lever 16 in contact with the latch/lever engagement portion 86 of the locking member 14, the locking member 14 is moved from the first or unlocked position, shown in FIGS. 1 and 2, to the second or locked position, shown in FIG. 3.

As the locking member 14 is moved from the first position to the second position, the retention member 84 of the locking member 14 is moved past the forward edge 95 of the handle 90 of the lever and into engagement with the upper surface 93 of the handle 90. As this occur, the retention member 84 exerts a force on the upper surface 93 of the handle 90, causing the handle 90 to be moved toward the lever engagement portion 86, and causing the projection 96 to move along the surface of the latch/lever engagement portion 86.

As the locking member 14 is moved from the first position to the second position, in embodiments in which the forward surface of the latch/lever engagement portion 86 abuts against the wall 64 when the locking member 14 is in the first position, the latch/lever engagement portion 86 is resiliently deflected toward the flat surface 62 of the latch/lever retention portion 36, thereby allowing the latch/lever engagement portion 86 to align with and be inserted through the opening 66 of the wall 64. This allows the locking member 14 to be moved from the first position to the second position.

As the locking member 14 is moved from the first position to the second position, the projections 80 of the flanges 78 are caused to deflect and move from the openings 58, thereby allowing the movement of the locking member 14 toward the latch/lever retaining portion 36. In addition, as the locking member 14 is moved from the first position to the second position, the back wall 72 of the locking member 14 is moved beyond the latch 42 of the lock member receiving portion 34.

In the locked position, as shown in FIG. 3, the retention member 84 of the locking member 14 captures the forward edge 95 of the handle 90 of the lever 16, preventing the handle 90 and the lever 16 from being rotated back to the unlatched position. In the second or locked position, the projections 80 of the flanges 78 of the locking member 14 are positioned in the openings 60 of the flanges 50 to prevent the unwanted movement of the locking member 14 from the locked position to the unlocked position.

In the locked position, the locking member 14 cooperates with the lever 16 to ensure that the lever is properly secured in the latched position. If the lever is not able to be fully rotated, the locking member 14 cannot be moved to the second or locked position. Consequently, the locking member 14 provides a visual and mechanical indication as to whether the assembly 10 is fully mated or not fully mated. Stated differently, until the lever 16 is properly positioned in the latched position and the assembly 10 is fully mated, the locking member 14 is unable to be moved to the second or locked position. The locking member 14 thus ensures proper latching by not allowing the locking member 14 to move to the locked position until the lever 16 is fully rotated and the assembly 10 is fully mated with a mating connector.

Once in the locked position, the lever 16 cannot be rotated back to the unlatched position without first moving the locking member 14 back to the first or unlocked position. The locking member 14 thus ensures continuous latching of the assembly 10 even when the assembly is used in harsh environments, such as, but not limited to, environments in which the assembly 10 is exposed to vibration.

To disengage the lever 16 from the locked position, the locking member 14 is moved back to the position of FIG. 2 by applying sufficient force to the locking member 14 so that the projections 80 of the flanges 78 are caused to deflect from the openings 60, allowing the projections 80 to move from the openings 60, thereby allowing the movement of the locking member 14 toward the first position or unlocked position. As this occurs, the retention member 84 of the locking member 14 moves away from the forward edge 95 of the handle 90 of the lever 16, allowing the handle 90 and the lever 16 to be rotated back to the unlatched position.

While the invention has been described with reference to an illustrative embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector assembly comprising:

a housing;

a cover having a locking member receiving portion and a lever retaining portion;

a lever rotatable between an unlatched position and a latched position, the lever being positioned in the lever retaining portion when the lever is in the latched position;

a locking member movably retained in the locking member receiving portion, the locking member moveable between an unlocked position and a locked position;

a portion of the locking member positioned in the lever retaining portion when the locking member is in the locked position;

wherein the locking member engages the lever when the locking member is in the locked position to properly secure the lever in the latched position and to ensure continuous latching of the connector assembly.

2. The connector assembly as recited in claim 1, wherein the locking member receiving portion includes a retaining latch which cooperates with the locking member to retain the locking member in the locked position and the unlocked position.

3. The connector assembly as recited in claim 2, wherein the locking member receiving portion includes flanges on either side of the retaining latch, the flanges include inwardly extending ridges with openings which cooperate with the locking member to retain the locking member in the locked position and the unlocked position.

4. The connector assembly as recited in claim 1, wherein the lever retaining portion includes a projection with an opening which extends therethrough.

5. The connector assembly as recited in claim 1, wherein the locking member has a top wall, a back wall, a front wall and sidewalls, flanges extend outwardly from the sidewalls, projections extend from the flanges, the flanges cooperate with locking member receiving portion flanges to movably retain the locking member in the locking member receiving portion.

6. The connector assembly as recited in claim 5, wherein a retention member extends from the top wall in a direction away from the back wall, the retention member engages the lever when the locking member is in the locked position.

7. The connector assembly as recited in claim 5, wherein a lever engagement portion of the locking member extends into the lever retaining portion when the locking member is in the unlocked position, the lever engagement is positioned proximate to the retention member and cooperates with the lever as the lever is moved from the unlatched position to the latched position.

8. A connector assembly comprising:

a cover having a locking member receiving portion and a latch retaining portion;

a latch movable between an unlatched position and a latched position, the latch being positioned in the latch retaining portion when the latch is in the latched position;

a locking member movably retained in the locking member receiving portion, the locking member moveable between an unlocked position and a locked position;

a portion of the locking member is positioned in the latch retaining portion when the locking member is in the locked position;

wherein the locking member engages the latch when the locking member is in the locked position to properly secure the latch in the latched position and to ensure continuous latching of the connector assembly.

9. The connector assembly as recited in claim 8, wherein the locking member has a top wall, a back wall, a front wall and sidewalls, flanges extend outwardly from the sidewalls, projections extend from the flanges, the flanges cooperate with locking member receiving portion flanges to movably retain the locking member in the locking member receiving portion.

10. The connector assembly as recited in claim 9, wherein a retention member extends from top wall in a direction away from the back wall, the retention member engages the latch when the locking member is in the locked position.

11. The connector assembly as recited in claim 10, wherein a lever engagement portion of the locking member extends into the lever retaining portion when the locking member is in the unlocked position, the latch engagement portion is positioned proximate to the retention member and cooperates with the latch as the latch is moved from the unlatched position to the latched position.

12. The connector assembly as recited in claim 11, wherein the latch retaining portion includes a projection with an opening which extends therethrough.

13. The connector assembly as recited in claim 12, wherein the locking member receiving portion includes a retaining latch which cooperates with the locking member to retain the locking member in the locked position and the unlocked position.

14. The connector assembly as recited in claim 13, wherein the locking member receiving portion includes flanges on either side of the retaining latch, the flanges include inwardly extending ridges with openings which cooperate with the locking member to retain the locking member in the locked position and the unlocked position.

15. A connector assembly comprising:

a cover having a locking member receiving portion and a latch retaining portion;

a latch movable between an unlatched position and a latched position, the latch being positioned in the latch retaining portion when the latch is in the latched position;

a locking member movably retained in the locking member receiving portion, the locking member moveable between an unlocked position and a locked position, the locking member having a retention member and a latch engagement portion, the retention member engaging the latch when the locking member is in the locked position, the lever engagement portion positioned proximate to the retention member and cooperating with the latch as the latch is moved from the unlatched position to the latched position;

wherein the retention member engages the latch when the locking member is in the locked position to properly secure the latch in the latched position and to ensure continuous latching of the connector assembly.

16. The connector assembly as recited in claim 15, wherein the locking member has a top wall, a back wall, a front wall and sidewalls, flanges extend outwardly from the sidewalls, projections extend from the flanges, the flanges cooperate with locking member receiving portion flanges to movably retain the locking member in the locking member receiving portion.

17. The connector assembly as recited in claim 16, wherein the retention member extends from top wall in a direction away from the back wall.

18. The connector assembly as recited in claim 17, wherein the latch engagement portion extends between the sidewalls.

19. The connector assembly as recited in claim 18, wherein the latch retaining portion includes a projection with an opening which extends therethrough.

20. The connector assembly as recited in claim 19, wherein the locking member receiving portion includes a retaining latch which cooperates with the locking member to retain the locking member in the locked position and the unlocked position.

* * * * *